US010973340B2

(12) United States Patent
Hegg

(10) Patent No.: US 10,973,340 B2
(45) Date of Patent: Apr. 13, 2021

(54) POCKET MATTRESS COMPRISING OPENINGS IN THE CASING MATERIAL

(71) Applicant: Starsprings AB, Herrljunga (SE)

(72) Inventor: Lennart Hegg, Ljung (SE)

(73) Assignee: Starsprings AB, Herrljunga (SE)

( * ) Notice: Subject to any disclaimer, the term of this patent is extended or adjusted under 35 U.S.C. 154(b) by 224 days.

(21) Appl. No.: 15/813,808

(22) Filed: Nov. 15, 2017

(65) Prior Publication Data

US 2019/0142179 A1 May 16, 2019

(51) Int. Cl.
*A47C 27/06* (2006.01)
*B68G 9/00* (2006.01)

(52) U.S. Cl.
CPC ..... *A47C 27/064* (2013.01); *B68G 9/00* (2013.01)

(58) Field of Classification Search
CPC ... A47C 12/064; A47C 27/065; A47C 27/063; A47C 27/06; B68G 9/00; B60G 2206/921
See application file for complete search history.

(56) References Cited

U.S. PATENT DOCUMENTS 1,287,662 A * 12/1918 Foster ..... A47C 27/064 5/655.8
3,720,966 A * 3/1973 Zysman ..... A47C 7/20 5/655.7
3,765,038 A 10/1973 Curtis
6,591,438 B1 7/2003 Edling
7,748,065 B2 7/2010 Edling
8,087,114 B2 * 1/2012 Lundevall ..... A47C 27/063 267/166
2017/0283245 A1 * 10/2017 Long ..... A47G 9/00

FOREIGN PATENT DOCUMENTS

CN 206590894 U 10/2017
GB 457044 A 11/1936
JP 11318642 A * 11/1999 ..... A47C 27/064

OTHER PUBLICATIONS

Extended European Search Report dated Dec. 8, 2017 issued in corresponding European Application No. 17201845.9.
European Office Action dated Jul. 29, 2020, issued in corresponding European Patent Application No. 17 201 845.9.

* cited by examiner

*Primary Examiner* — Robert G Santos
*Assistant Examiner* — Alison N Labarge
(74) *Attorney, Agent, or Firm* — Harness, Dickey & Pierce, P.L.C.

(57) ABSTRACT

A spring mattress is disclosed, comprising a plurality of interconnected coil springs enclosed in casings, thereby forming a pocket spring mattress. For at least one of the springs, the casing portions arranged at the ends of the spring being moved towards each other, through the spring, and interconnected with the aid of connecting means, such as a weld. Further, the casing portions at the ends of the spring comprise an opening through the spring. Hereby, the casing forms a toroid or doughnut shape enclosing the spring.

17 Claims, 5 Drawing Sheets

POCKET MATTRESS COMPRISING OPENINGS IN THE CASING MATERIAL

TECHNICAL FIELD OF THE INVENTION

The present invention relates to a spring mattress comprising springs enclosed in casings, a so-called pocket mattress. The invention is also related to a method and device for producing such mattresses.

BACKGROUND OF THE INVENTION

A common technique of making spring mattresses is the so-called pocket technique. This means that the springs are enclosed in pockets, i.e. they are individually enclosed by a casing material. In this way, the springs will be relatively individually resilient so that they can flex individually without affecting the neighboring springs and, thus, the comfort to the user increases since the weight will be distributed more uniformly over the surface that receives the load.

A drawback of this type of mattress is, however, that it is difficult to provide thin mattresses. If the length of the springs is reduced without a corresponding reduction of the width, the spring will, especially when the length approaches the length of the diameter of the spring, have a tendency to turn in the casing, which dramatically deteriorates the comfort of the mattress. When such mattresses are to be manufactured, the existing technique requires the use of a much larger number of springs. Consequently the manufacturing will be considerably more expensive and more complicated. Besides it is difficult to prevent such mattresses from also being stiffer since too thin spring wires cannot be used.

For these reasons, it has not been possible to use spring mattresses for many purposes where thinner mattresses are required, such as for overlay mattresses, seat cushions and the like. In spite of this, spring mattresses have several properties making it desirable to use them also in these contexts, such as excellent comfort, individual flexibility, a long life and easy and inexpensive manufacture.

A solution to this problem has been presented by the same applicant in U.S. Pat. Nos. 6,591,438, 7,748,065 and 8,087,114. Here, the end portions of the casings are moved towards each other and connected to each other through the springs, which gives a bias of the springs, and a very compact and useful mattress. This enables production of very thin pocket spring mattresses.

However, there is still a need for improvements of pocket mattresses in terms of comfort and sleeping quality. There is also a general need to improve the longevity of the mattresses.

SUMMARY OF THE INVENTION

It is an object of the present invention to provide a pocket spring mattress, as well as a method and a device for manufacturing the same, that at least partly overcomes or alleviates the above-discussed problems.

This object is achieved by a spring mattress as well as a method and a device for manufacturing the same according to the claims.

This and other objects are achieved by a spring mattress comprising a plurality of interconnected coil springs enclosed in casings, wherein for at least one of the springs, casing portions arranged at the ends of the spring are connected to each other through the spring via a joint, and the joined casing portions comprising an opening through the spring.

This mattress is of the general type as disclosed in U.S. Pat. Nos. 6,591,438, 7,748,065 and 8,087,114 by the same applicant, which are herewith incorporated by reference, and thus has essentially all advantages that are associated with this type of mattress, such as the possibility of making the mattress thin, the advantageous bias of the springs etc. However, the inventive mattress also gives a number of additional advantages.

By providing an opening in the interconnection of the casing portions through the springs the aeration and ventilation through the mattress is improved. A significant volume of moisture leaves the body during sleep. Thanks to the improved aeration/ventilation, this moisture will be taken care of more efficiently, and without making the mattress damp. The moisture will more efficiently be removed from the user's body, and away from the mattress. Further, this improves the comfort and sleeping quality, and will enable a more stable sleeping temperature and humidity for the user. This will make temperature regulation for the user easier. Also, the reduction of damp and moisture in the mattress will counteract assembly and growth of dust mites, mold, bacteria etc, and will thereby maintain the mattress in a hygienic condition for a much longer time. This will also reduce the risk for development of allergies. It will also reduce the risk of unwanted odors. Overall, the improved aeration and ventilation will make it possible to maintain the mattress in a clean and hygienic state for a much longer time, thereby increasing the longevity of the mattress.

The present invention is based on the realization that in this particular type of mattress, i.e. a pocket spring mattress in which the casing portions arranged at the ends of the spring has been joined to each other through the spring, aeration and ventilation can easily be provided by provision of an opening through the joint, i.e. through the spring. Not only does this greatly improve the aeration and ventilation through the mattress, but also it does not in any way deteriorate or affect the other properties of the mattress. The mattress functionally performs in the same way as previously known mattresses of the same type, but with a greatly improved aeration and ventilation.

In accordance with the present invention, each pocket, i.e. the casing enclosing each spring, is formed as a toroid, having a doughnut shape, forming a circular compartment enclosing the spring.

The casing portions may be indirectly joined, i.e. without being in direct contact with each other. However, preferably the casing portions may be moved so far towards each other as to contact each other. It is also preferred for the casing portions at the spring ends to be moved so far towards each other that the springs are biased. By letting the casing portions contact each other there is only a need for one common opening through the spring.

The connection of the casing portions is preferably given such a size and shape that the connection obtains sufficient strength and stability. Furthermore, the shape and size of the connection can be varied to give different degrees of bias of the springs. In this way, it is possible to easily vary the bias between different mattresses, and also between different springs in one and the same mattress. Preferably, the connection forms a symmetric joint area.

In a preferred embodiment, the opening is arranged within the perimeter of the joint of the casing portions.

The opening may have various shapes, such as quadratic, rectangular or oval. However, preferably the opening has a symmetric shape, and most preferably the opening is substantially circular.

The average diameter of opening is preferably within the range 2-50% of the average diameter of the spring, and preferably within the range 5-30%, and most preferably within the range 10-25%. Also, the ratio of the average spring diameter to the average diameter of the opening may be between 2 and 8, preferably between 3 and 6, and most preferably between 3 and 4. The opening may have an average diameter in the range of 0.1-3 cm, and preferably within the range 0.5-2 cm, and most preferably within the range 0.7-1.5 cm.

Different sizes to the opening my be used depending on the type of spring and the desired ventilation for the mattress.

The joint may be formed by a mechanical connecting element, preferably a clamp. Alternatively, the joint may be formed by a surface joint, such as a glue, a welding or the like.

The casing portions may be connected by a plurality of welding points distributed around the opening. For example, the joint may comprise 2, 3, 4, 6 or 8 welding points. Alternatively, the casing portions may be connected by a continuous welding around the opening. By providing welding around the opening proper strength is maintained in the interconnection in spite of the opening. The welding points may be symmetrically arranged around the opening to ensure sufficient strength in the interconnection.

The casings may form a plurality of strings interconnected side by side, each string comprising a continuous casing material, the casings being defined by at least one longitudinal connecting line extending parallel to the longitudinal direction of the string and a plurality of transverse connecting lines extending transversely to the longitudinal direction of the string, and coil springs arranged in the casings of the string. Preferably, the connecting lines are arranged at the side of the springs, and thus between neighboring springs.

Connecting lines extending over the ends of the springs cause problems with so-called false lofts, that is accumulations of material over the springs which increase the height of the mattress but do not exhibit resilience and, thus, do not add to the comfort of the mattress. On the contrary, such false lofts can give a lumpy and uneven surface, which reduces comfort. By arranging the connecting lines With the new mattress, the occurrence of such false lofts is effectively avoided, and the height of the mattress corresponds substantially to the height of the springs, with a single smooth casing layer over the ends of the springs. The relatively smooth casing at the ends of the springs also gives the possibility of easily fastening the end portions of the casing to each other through the springs, by, for instance, welding, which enables very efficient and cost-effective manufacture.

The longitudinal connecting lines and the transverse connecting lines of the strings preferably extend substantially at right angles to the longitudinal axes of the springs. Furthermore, the longitudinal connecting lines and the transverse connecting lines of the strings preferably extend in essentially the same plane, which plane preferably is substantially perpendicular to the longitudinal axes of the springs.

Connecting the strings to each other via the longitudinal connecting lines has been found very advantageous. By the longitudinal connecting lines, which typically consist of welds, in many cases projecting from the string, an advantageous separation of the strings is automatically obtained. Moreover, the strings are in this way attached to each other only along a line, and preferably only at a number of points along this line. This has been found to give a very flexible mattress, where the springs are extremely movable in relation to their neighbors.

However, other ways of providing a mattress with a plurality of casings forming individual pockets are also feasible. For example, the casings may be formed by a relatively large upper sheet and a relatively large lower sheet, the sheets being connected together along longitudinal and lateral connections lines, e.g. forming a checkerboard pattern, thereby forming the individual pockets for the springs. Thus, in such an embodiment, the pockets are integrated with each other be the same material not only in one direction, as in the above-discussed string embodiments, but in two directions, i.e. both in a length and width dimension.

The casing is preferably a textile material, and preferably a weldable textile material.

The connection of the casing portions at the ends of the spring may be such that the spring is biased. By biasing the springs a mattress of lesser thickness, than what is otherwise achievable, may be provided.

The connecting means may be arranged in such manner as to provide a desired overlap between the casing portions, the thus-obtained overlap determining the bias of the spring.

The spring may be biased so that the length of the spring in the biased state is smaller than ⅔ of the length of the same spring in a non-biased state, preferably smaller than ½.

The spring may have a height which is less than the width of the springs, preferably less than ⅔ of the width, and most preferred is about ½ of the width or less.

The biasing of springs creating springs of small length gives a lesser thickness of the mattress, which is advantageous in a number of applications.

According to an embodiment of the invention, the spring mattress comprises a plurality of biased springs, wherein at least some of the springs are differently biased. The springs may then be differently biased so as to form portions of the mattress of varying thickness.

By biasing the springs differently different support and elasticity can be achieved in different regions of the mattress, for instance in the head region, hip region and foot region of a mattress for a bed.

According to a second aspect of the present invention, there is provided a device for biasing coil springs enclosed in casings, comprising an inserter and a counteracter arranged at a distance therefrom, the inserter and the counteracter being adapted to perform a relative displacement towards and away from each other to bring casing materials at the spring ends of a spring arranged there between towards each other through the spring, such that the spring becomes biased, and an interconnector for forming a joint connecting the thus brought-together casing materials from the two spring ends, characterized in that the device further comprises a punch for punching an opening in the interconnection between the casing materials from the two spring ends.

With this device, a mattress of the type discussed above may be manufactured, and corresponding advantages as related with regard to this new mattress and method are achieved by this device.

Preferably the means for moving casing portions arranged for the ends of the spring towards each other and connecting them to each other comprises welding equipment movable in the spring direction. The welding equipment is preferably adjustable, the size of the generated weld thereby being controllable. As a result, the bias of the springs and the height of the mattress can easily be controlled and varied, both between different mattresses manufactured by the same device and within one and the same mattress, to obtain zones with different properties within the mattress.

In one embodiment, the inserter and counteracter may be arranged both to provide the connection, e.g. by welding, and to form the opening, e.g. by punching.

According to yet another aspect of the present invention, there is provided a method for manufacturing a spring mattress comprising a plurality of interconnected coil springs enclosed in casings, comprising the steps of enclosing the springs in a casing material, biasing at least one of the springs, and interconnecting the springs, the step of biasing the springs comprising the partial steps of moving casing portions arranged for the ends of the spring towards each other, through the spring and interconnecting them by means of a joint, and further comprising forming an opening in the joint, through the spring.

With this method, a mattress of the type discussed above may be manufactured, and corresponding advantages as related with regard to this new mattress are achieved.

The step of forming the opening in the joint may be performed prior to forming the joint, after formation of the joint, or simultaneously with the joint formation. In case the forming of the opening is made prior to forming the joint, the forming of the opening may be made prior to insertion of a spring into the casing/pocket, or alternatively after insertion of the spring.

These and other advantages of the current invention will be evident from the following detailed description of specific embodiments.

BRIEF DESCRIPTION OF THE DRAWINGS

The present invention will be described in more detail with reference to the appended drawings, showing embodiments of the invention.

As illustrated in the figures, the sizes of layers and regions may be exaggerated for illustrative purposes and, thus, may be provided to illustrate the general structures of embodiments of the present invention. Like reference numerals refer to like elements throughout.

DETAILED DESCRIPTION OF THE INVENTION

For the purpose of exemplification, the invention will now be described in more detail by way of an embodiment and with reference to the accompanying drawings.

Figure 1:
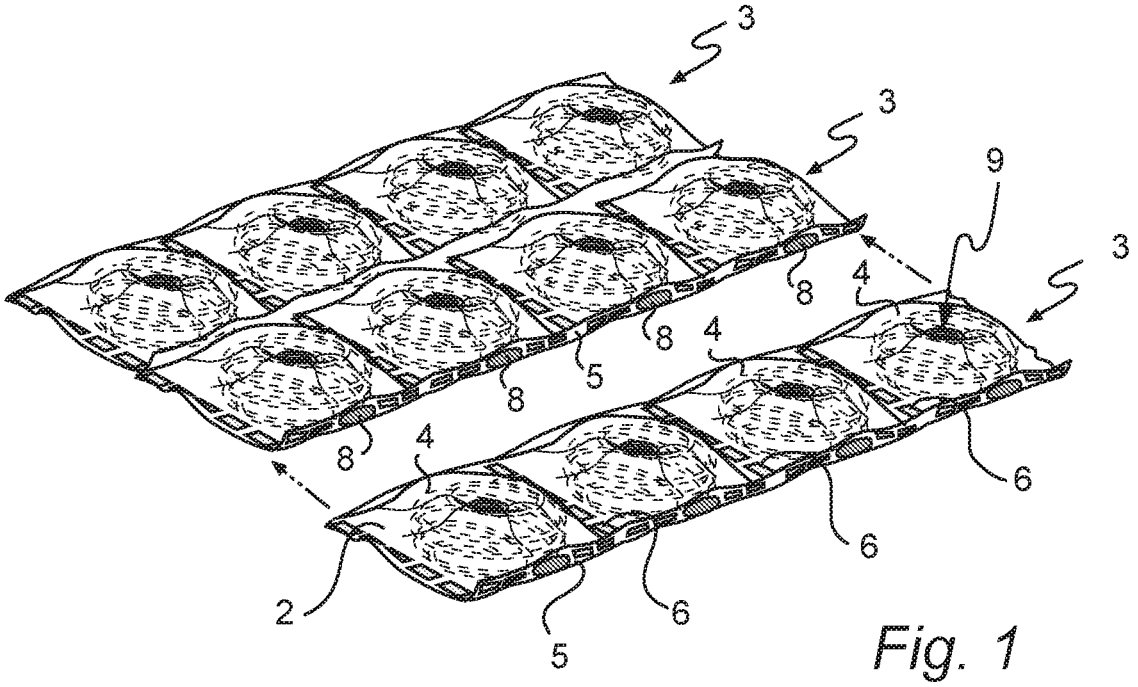
FIG. 1 is a perspective view of a part of a mattress according to an embodiment of the invention.
Figure 2:
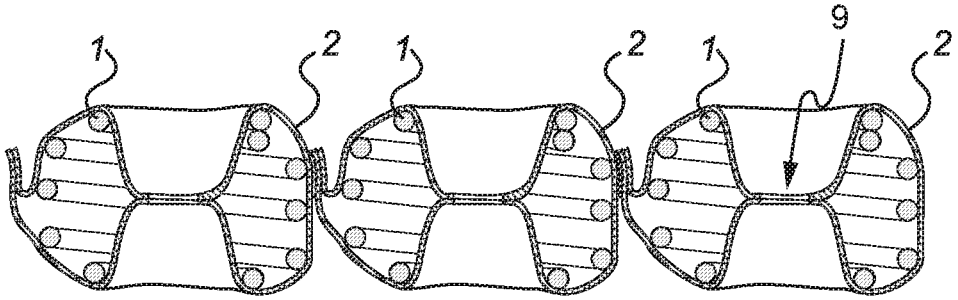
FIG. 2 is a sectional side view of part of the mattress in FIG. 1 seen in the string direction.

A spring mattress according to an embodiment of the invention comprises a plurality of interconnected coil springs 1 enclosed in casings 2, as shown in FIGS. 1 and 2. The casing is suitably made of a, preferably weldable, textile material, but also other materials, such as different types of plastic materials, can be used. It is also possible to use non-weldable textile materials, such as cotton cloth.

The mattress comprises strings 3 of casing material 2, in which a plurality of pockets 4 are arranged. The pockets are here defined by at least one longitudinal connecting line 5 extending parallel to the longitudinal direction of the string and a plurality of transverse connecting lines 6 extending transversely to the longitudinal direction of the string. Preferably the strings comprise casing material of a folded piece of material, where the fold line extends in the longitudinal direction of the string. The closing longitudinal connecting line 5 is arranged at the opposite side of the string. Transverse connecting lines then extend between the fold line and the longitudinal connecting line. Alternatively, it is possible to use two or more pieces of material for making each string, in which case additional connecting lines may be required.

In the mattress, the springs are here oriented in the pockets so that the connecting lines are arranged at the side of the springs and, thus, between neighboring springs. Preferably, the casing material portions at the ends of the springs are thus essentially free of other connections. However, it is also possible to arrange the longitudinal connection line on top of the strings, overlying the spring ends.

According to an embodiment of the invention, for at least one of the springs, the casing portions arranged at the ends of the springs are moved towards each other, through the spring, and connected to each other by connecting means 7 to provide at least a certain degree of bias. Preferably the casing portions are moved so far towards each other as to make contact with each other, but of course it is possible to interconnect them also otherwise, by wire, a long clamp or the like. The connecting means may consist of a mechanical connecting element, such as a clamp, a rivet or the like, or by a surface joint, such as an adhesive, a weld or the like. Other fixing elements are, however, also conceivable. The load on the fixing element is normally small since the fixing elements are only loaded when the mattress is unloaded, whereas there is no load at all when the mattress is loaded. In a preferred embodiment, the joint is formed by one or several weld(s).

Figure 5:
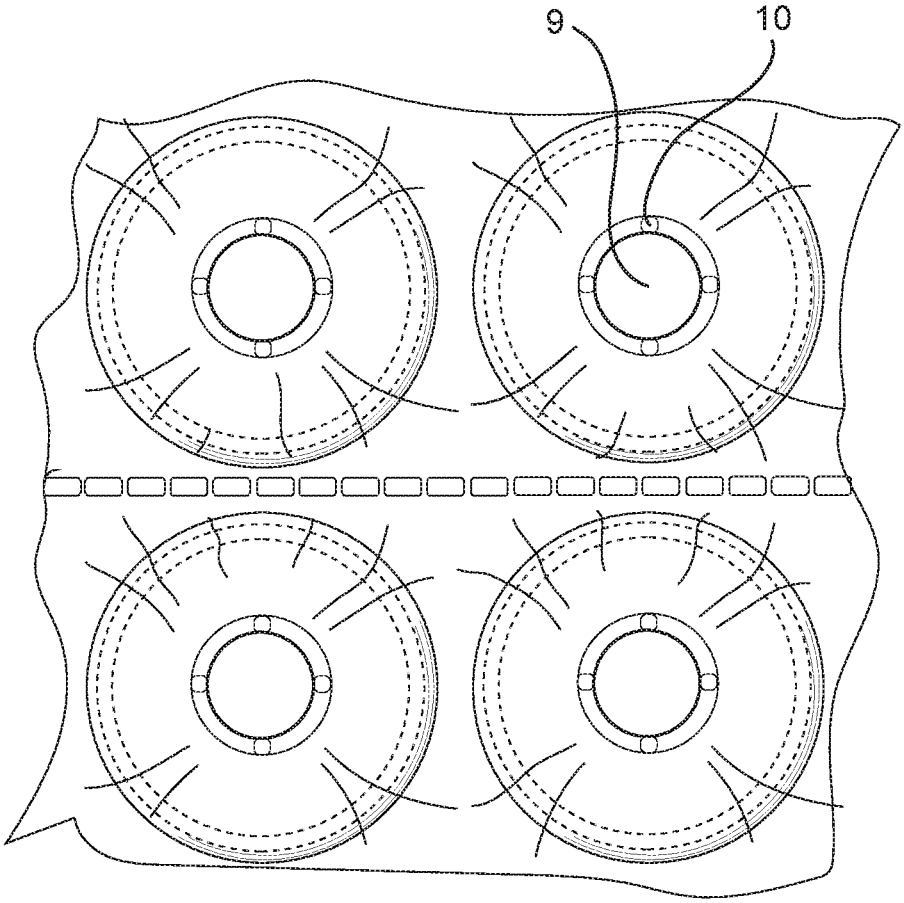
FIG. 5 is a view of part of the mattress as seen from above.

Further, end portions comprise an opening 9 through the joint, and through the spring. The opening 9 may preferably be substantially circular, but other shapes may also be used. Openings 9 though the length of the spring can help provide proper ventilation of the mattress. The opening is here substantially circular, as seen in FIG. 5, however other shapes of the opening can also be used. The diameter of the opening may for instance be between 5 mm and 50 mm, preferably between 10 mm and 30 mm, more preferably between 15 mm and 25 mm.

The end portions are here connected by welding points 10 distributed around the substantially circular opening 9, as seen in FIG. 5. Here four welding points are distributed around the opening, however any number of welding points, such as three, six or eight, can be used. Alternatively, a continuous weld around the opening can be used. The end portions are preferably connected to each other by welding, in which case a weld surface is arranged to connect the end portions to each other. The size and/or the location of the weld can advantageously be controllable and may be selected to give a desired height of the mattress and bias on the springs.

Coil springs of many sizes can be used in connection with the present invention, and basically any size of spring can be used. However, it is preferred to use springs with a diameter of 2-10 cm, most preferred about 6 cm. The springs preferably comprise at least three turns, preferably fewer than 10 turns. Moreover they are advantageously made of spiral wire with a thickness in the range 0.5-3.0 mm, preferably a wire thickness in the range 1.25-2.50 mm. Preferably the springs are slightly spool-shaped, that is with smaller turns at the top and bottom.

In a mattress as described above, as illustrated in FIGS. 1 and 3, the strings with springs are preferably arranged side by side and fixed to each other. Preferably the rows are connected to each other by fixing points 8, which advantageously connect the longitudinal connecting line 5 of one string to the side of the neighboring string. Of course, a smaller or greater number of fixing points than is shown is conceivable. It is also possible to arrange a longer fixing line instead of a plurality of shorter fixing points. The connection of strings to each other can occur by welding or gluing. Preferably, the welding or gluing surface is distributed around the opening to provide good strength to the interconnection. This may for instance be achieved by point surfaces distributed symmetrically around the opening or by a continuous line surface around the opening. Also this connection can, however, alternatively occur by means of clamps, by Velcro tape, or in some other-suitable manner.

By arranging the interconnection of the strings via the longitudinal connecting line, automatic separation of the strings is provided, without requiring additional casing material. This is advantageous on the one hand since it results in a mattress with fewer springs, which has been found very favorable from the viewpoint of comfort and, on the other, since the mattress will thus be more cost-effective.

The solution with strings of continuous casing material in which there are individual casings for the springs is merely one of many ways to carry out the invention. The invention may for instance involve individual casings for the springs which are then attached to each other or a continuous sheet of casing material for the whole mattress comprising casings for the individual springs, or any other solution when it comes to the casing material.

The mattress according to the invention can be manufactured by enclosing springs in pockets in strings of a casing material, the pockets being made of a continuous casing material with at least one longitudinal connecting line extending parallel to the longitudinal direction of the string and a plurality of transverse connecting lines extending transversely to the longitudinal direction of the string. Moreover, the method comprises the steps of moving casing portions arranged for the ends of the spring towards each other, connecting them to each other and punching or by any other means creating an opening through the casing portions at the ends of the spring. There might further be a step of interconnecting strings side by side.

For instance, the strings can be manufactured by the casing material being folded in two, and transverse welds being arranged to form open pockets. Subsequently compressed springs are inserted into the pockets, after which the pockets are sealed by a weld extending along the string. Moreover there is arranged, preferably without turning the springs, an additional weld through each spring for connecting the end portions to each other, an opening is punched through the casing portions at the ends, preferably in the middle of a number of welding points or a continuous weld, and a plurality of springs are joined side by side to form a mattress, the longitudinal welds being positioned between the strings.

The steps can be performed in different orders, and so that the connecting lines are arranged at the side of the springs and, thus, between neighboring springs. The step of moving the end portions towards each other usually implies that bias occurs by connection by means of connecting elements in such a manner that the springs in the biased state have a smaller longitudinal extent than in the original, non-biased state. Such bias can occur either directly after encapsulating the springs in the casing material, that is before they are assembled to form a mattress, or once the mattress is assembled. Preferably, however, bias occurs before the springs are enclosed in the pockets of strings, in which case it is possible to use a considerably smaller amount of casing material. Especially the amount of casing material can be made smaller the greater the bias and the thinner the mattress. In this manner, conveniently all springs in the mattress layer are biased.

In the manufacture of mattresses, it may also be ensured, as discussed above, that at least two neighboring strings are connected to each other so that an intermediate separation distance is provided between them.

Figure 3:
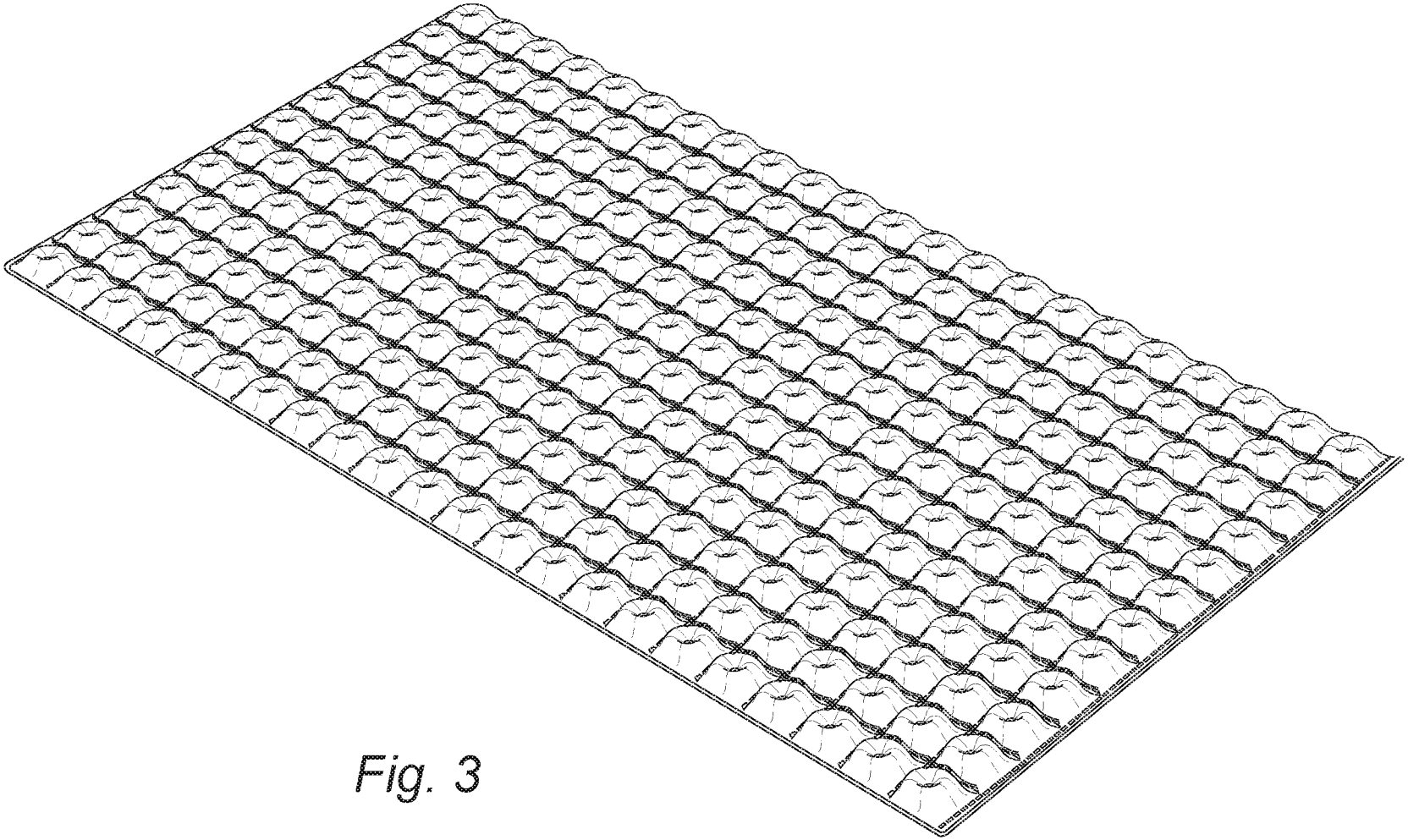
FIG. 3 is a perspective view obliquely from above of the mattress in FIGS. 1 and 2.

Moreover, the strings with springs are preferably interconnected side by side, as indicated in FIG. 3 for instance. As mentioned above, this can take place by arranging fixing points on the longitudinal connecting lines for fastening at the side of neighboring strings.

Figure 4:
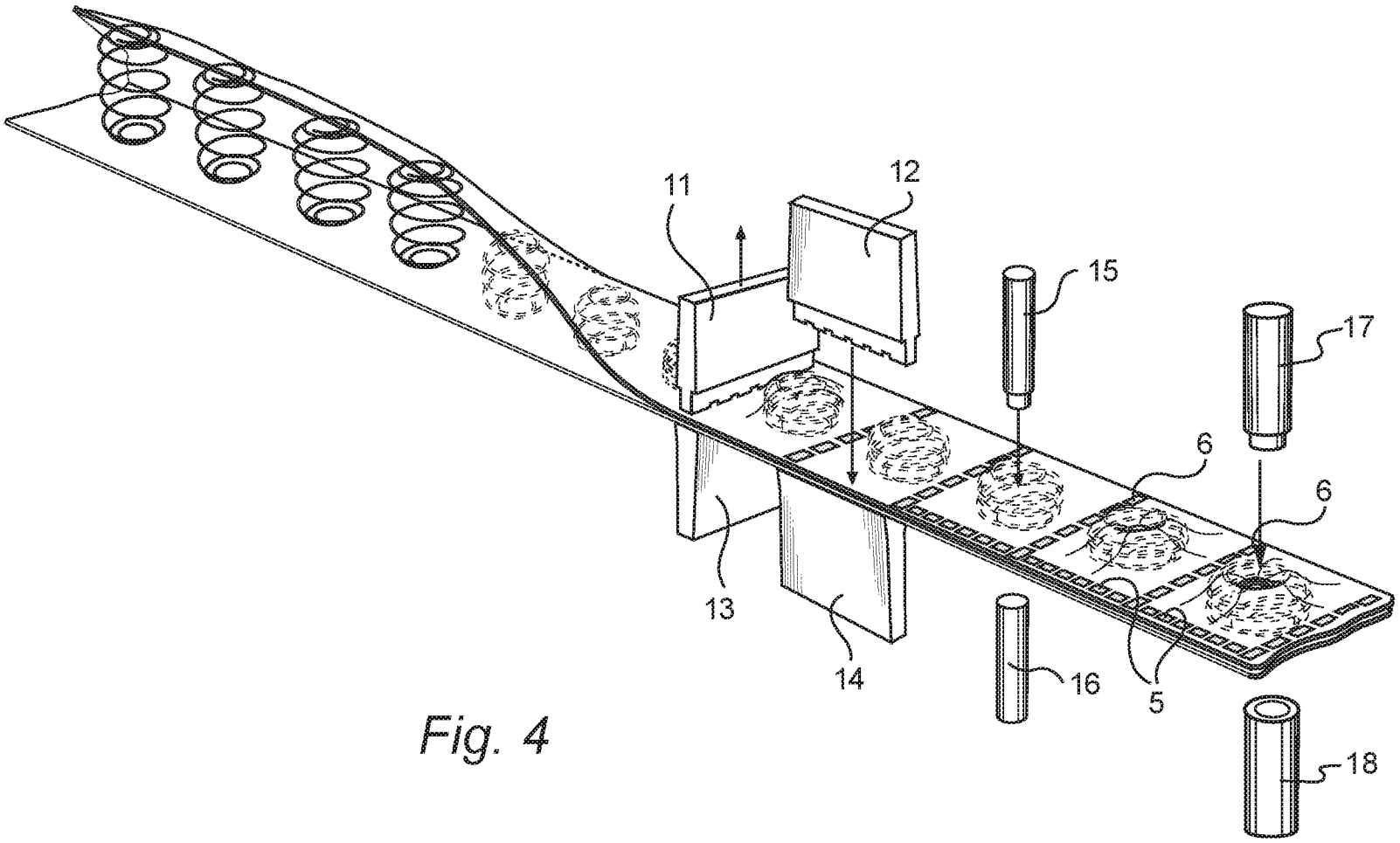
FIG. 4 is a schematic perspective view obliquely from above of a device for manufacturing a mattress according to an embodiment of the invention.

A device for carrying out the method above comprises means for enclosing coil springs in pockets of strings, the pockets being made of a continuous casing material with at least one longitudinal connecting line extending parallel to the longitudinal direction of the string and a plurality of transverse connecting lines extending transversely to the longitudinal direction of the string. These means may comprise a device for folding casing material around a row of springs, and equipment for welding of connecting lines in the folded casing material, as schematically illustrated in FIG. 4. Instead of compressing the springs when placed in the casing, and while the casing is being folded over them, it is alternatively possible to compress the springs separately and then, in the compressed state, insert them into the folded casing.

The welding equipment preferably comprises welding dies 11, 12 which are movable towards the casing material, and corresponding anvils 13, 14 on the opposite side. Preferably separate pieces of welding equipment are arranged to generate the longitudinal connecting lines and the transverse connecting lines respectively. The means for enclosing the coil springs is adapted to arrange the connecting lines at the side of the springs so that they are positioned between neighboring springs of the completed mattress.

Further, the device comprises means for moving casing portions arranged for the ends of the spring towards each other and connecting them to each other and means for interconnecting strings side by side.

The means for moving casing portions arranged for the ends of the spring towards each other and connecting them to each other preferably comprises an inserter 15 and, arranged at a distance therefrom, an anvil or counteracter 16. In use, springs are placed so that one end faces the inserter and the other the anvil. The inserter is movable towards and away from the anvil to move casing material at one spring end through the spring towards the casing material on the other side. The inserter 15 is preferably a welding die for generating a connecting weld. Alternatively, however, other fixing means can be provided instead. It is also possible to use a movable anvil, in which case both sides of the spring are pressed towards each other, after which stitching, welding or similar connecting may occur.

The device also comprises means for punching holes in the casing portions at the ends of the springs. The punch here comprises a punching piece 17 and an abutment or anvil 18, the punch 17 here being punched through the spring towards the abutment 18 and thereby punching out a substantially circular opening in the casing portions at the ends of the spring. Alternatively, the openings can be created by for instance cutting. The casing may also be pre-holed to create the openings before the other steps.

Figure 6:
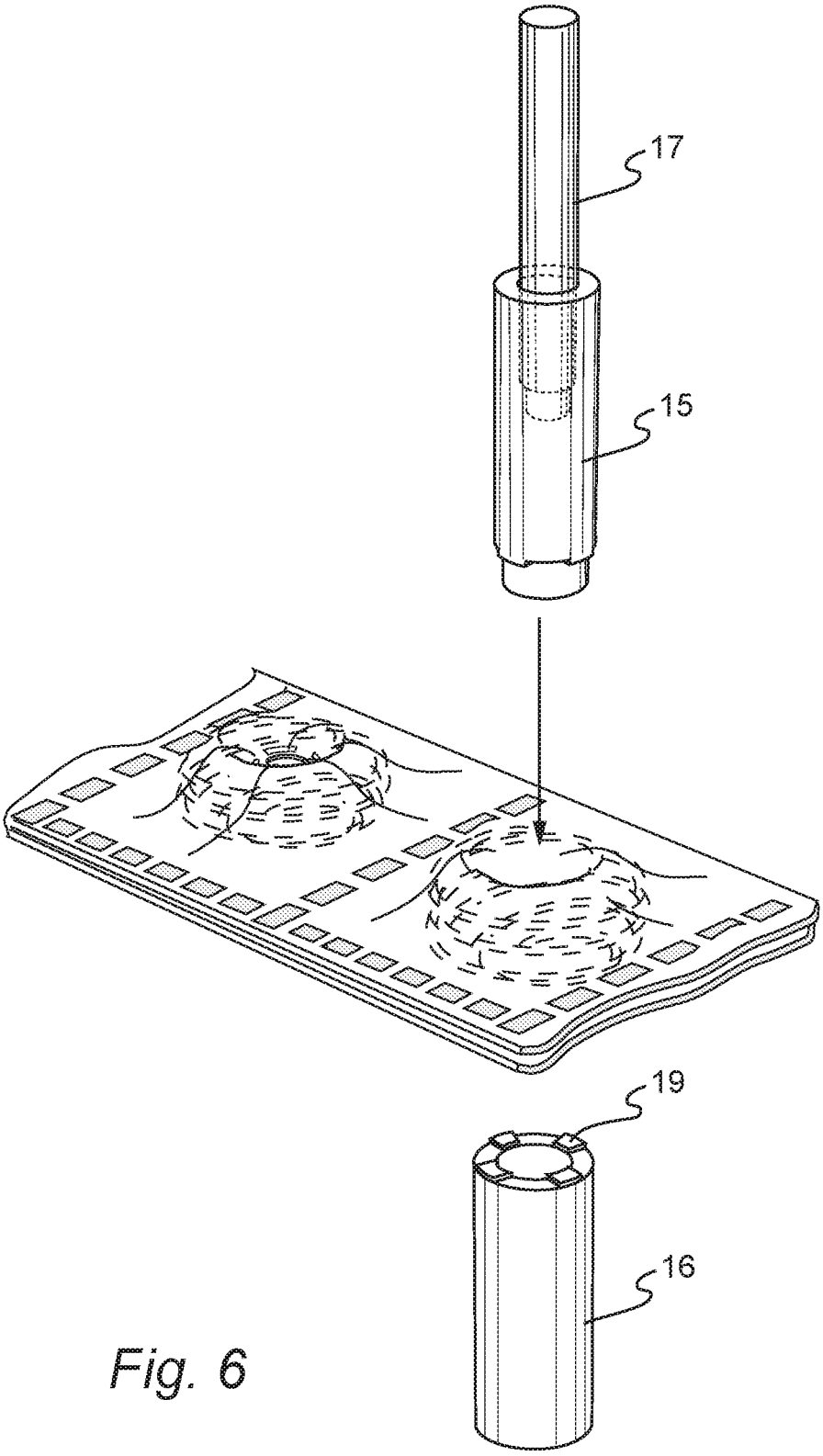
FIG. 6 is a schematic perspective view obliquely from above of the step of punching holes in the manufacture of a mattress according to an alternative embodiment of the invention.

The interconnection of the casing portions may also be created in the same step as the creation of the opening, for instance by creating welding points around the punching simultaneously as doing the punching, as seen in FIG. 6. A circular insertion means 15 is here attached to a circular connecter 16 while a punch 17 travels through the tube shaped inserter and punches a hole in the casing portions through the spring. The connecter here comprises four protrusions 19 in the profile of the part to be connected to the insertion means, the protrusions defining the welding points to be created between the casing portions.

A system according to the invention can advantageously comprise a plurality of parallel devices, such as two devices operating in parallel.

Moreover, means are included for interconnecting the strings with springs preferably side by side, as indicated in FIG. 3 for instance. As mentioned above, this can take place by arranging fixing points on the longitudinal connecting lines for fastening to the side of neighboring strings.

It is preferred for the bias of the springs to be performed so that the length of the springs in the biased state is less than ⅔ of the length of the same springs in the non-biased original state, and preferably less than ½. It is also preferred for the ratio between the length of the springs and the diameter thereof in the biased state to be less than 2, and preferably less than 1, and most preferred less than ½.

The mattress stated above ensures guiding of the spring, which thus is prevented from turning or the like. In contrast to prior-art mattresses, the new mattress comprises, however, pocket strings where the springs are inserted through openings in the lateral direction which are then welded together, but where the springs have then not been turned. As a result, the weld will be arranged along the sides of the springs instead of over the ends. Moreover the smooth end portions are moved towards each other and attached by welding for instance. Therefore very thin mattresses can be provided in this manner, in fact down to a thickness of one or a few centimeters. For example, a mattress with a thickness of 25 mm can be provided. Thus the invention might be well suited for seat cushions, overlay mattresses to be placed on top of other mattresses and similar applications where thin mattresses are required. Thus being able to make overlay mattresses of pocket springs is very advantageous, not only because they can be made softer, thereby increasing the comfort, but also because springs are normally not fatigued over time, as is polyethylene or like materials. Mattresses according to the invention can be made very light, soft and comfortable, and also, due to the bias, very rigid and hard, as desired. The opening through the spring also ensures good ventilation of the mattress, thus providing better drying, cooling and/or heating, less growth of bacteria and the like, and increased comfort.

The invention makes it possible to easily adjust the height of the spring elements by varying the position and size of the fixing means when connecting the end portions to each other. In this way it is also easy to provide different thicknesses of different portions of the mattress, or provide mattresses of different thicknesses, without having to make any changes in the manufacturing process in addition to this connection. The manufacture will in this way be very flexible and controllable. In particular it is possible to provide mattresses with a cup shape or the like to be used as seat cushions or other mattresses intended for sitting. Similar changes of height can also be used in other mattresses to control the user's position on the mattress.

The invention has been described above by way of embodiments. Several variants of the invention are, however, conceivable. For instance, as mentioned above, other types of fixing elements can be used, as well as other solutions for the casing material, spring sizes etc. Furthermore, the device and the method can be designed in other ways. Such obvious variants must be considered to be comprised by the invention as defined by the appended claims.

The invention claimed is:

1. A spring mattress, comprising:

a plurality of interconnected coil springs enclosed in casings, wherein for at least one spring of the plurality of interconnected coil springs, casing portions arranged at opposite ends of the at least one spring are joined casing portions that are connected to each other through the at least one spring by a joint, wherein the joined casing portions comprise an opening through the at least one spring, wherein the joined casing portions at the opposite ends of the at least one spring are in direct contact with each other, the opening being a punched or cut out opening in the joined casing portions, the opening being arranged within a perimeter of the joint between the joined casing portions, wherein the joint is formed by a surface joint, wherein the joined casing portions are connected by a plurality of welding points that are distributed around the opening and are inside a volume space defined by the at least one spring so as to be located between the opening and the at least one spring.

2. The spring mattress of claim 1, wherein the opening is substantially circular.

3. The spring mattress of claim 1, wherein an average diameter of the opening is within a range of 2-50% of an average diameter of the at least one spring.

4. The spring mattress of claim 1, wherein the joint is formed by a mechanical connecting element.

5. The spring mattress of claim 1, wherein the casings form a plurality of strings interconnected side by side, each string of the plurality of strings comprising a continuous casing material, the casings being defined by at least one longitudinal connecting line extending parallel to a longitudinal direction of the string and a plurality of transverse connecting lines extending transversely to the longitudinal direction of the string, and the plurality of interconnected coil springs are arranged in the casings of the string.

6. The spring mattress of claim 5, wherein at least one longitudinal connecting line and the plurality of transverse connecting lines are arranged at sides of the plurality of interconnected coil springs, and thus between neighboring springs of the plurality of interconnected coil springs.

7. The spring mattress of claim 1, wherein the casings are made of a weldable textile material.

8. The spring mattress of claim 1, wherein a connection of the joined casing portions at the opposite ends of the at least one spring is such that the at least one spring is biased.

9. The spring mattress of claim 8, wherein the at least one spring is biased so that a length of the at least one spring in a biased state is smaller than ⅔ of the length of the at least one spring in a non-biased state.

10. The spring mattress of claim 1, wherein the at least one spring has a height which is less than a width of the at least one spring.

11. The spring mattress of claim 1, comprising a plurality of biased springs, wherein at least some biased springs of the plurality of biased springs are differently biased.

12. The spring mattress of claim 1, wherein an average diameter of the opening is within a range of 5-30% of an average diameter of the at least one spring.

13. The spring mattress of claim 1, wherein an average diameter of the opening is within a range of 10-25% of an average diameter of the at least one spring.

14. The spring mattress of claim 1, wherein the joint is formed by one of a glue or a weld.

15. The spring mattress of claim 1, wherein an average diameter of the opening is within a range of 0.5-5 cm.

16. A spring mattress, comprising:

a plurality of interconnected coil springs enclosed in casings, wherein for at least one spring of the plurality of interconnected coil springs, casing portions arranged at opposite ends of the at least one spring are joined casing portions that are connected to each other through the at least one spring by a joint, wherein the casings form a plurality of strings interconnected side by side, each string comprising a continuous casing material, the casings being defined by at least one longitudinal connection line extending parallel to a longitudinal direction of the string and a plurality of transverse connecting lines extending transversely to the longitudinal direction of the string, wherein the joined casing portions comprise an opening through the at least one spring, wherein the joined casing portions at the opposite ends of the at least one spring are in direct contact with each other, the opening being a punched or cut out opening in the joined casing portions, the opening being arranged within a perimeter of the joint between the joined casing portions, wherein the joint is formed by a surface joint, wherein the joined casing portions are connected by a welding joint that is inside a volume space defined by the at least one spring so as to be located between the opening and the at least one spring.

17. A spring mattress, comprising:

a plurality of interconnected coil springs enclosed in casings, wherein for at least one spring of the plurality of interconnected coil springs, casing portions arranged at opposite ends of the at least one spring are joined casing portions that are connected to each other through the at least one spring by a joint, wherein the casings comprise an upper sheet and a lower sheet, the upper sheet and the lower sheet being connected together along longitudinal and lateral connection lines, forming a checkerboard pattern, thereby forming individual pockets for the plurality of interconnected coil springs, wherein the joined casing portions comprise an opening through the at least one spring, wherein the joined casing portions at the opposite ends of the at least one spring are in direct contact with each other, the opening being a punched or cut out opening in the joined casing portions, the opening being arranged within a perimeter of the joint between the joined casing portions, wherein the joint is formed by a surface joint, wherein the joined casing portions are connected by a welding joint that is inside a volume space defined by the at least one spring so as to be located between the opening and the at least one spring.

* * * * *